United States Patent [19]

Fiedler

[11] 4,130,609

[45] Dec. 19, 1978

[54] STAGED ACCELERATOR PUMP

[75] Inventor: Timothy Fiedler, Florissant, Mo.

[73] Assignee: ACF Industries, Inc., New York, N.Y.

[21] Appl. No.: 863,883

[22] Filed: Dec. 23, 1977

[51] Int. Cl.[2] ..... F02M 7/08

[52] U.S. Cl. ..... 261/23 A; 261/34 A; 417/328; 417/471

[58] Field of Search ..... 261/34 A, 23 A; 417/328, 471; 92/84

[56] References Cited

U.S. PATENT DOCUMENTS

| | | | |
|---|---|---|---|
| 2,246,825 | 6/1941 | Winfield | 261/34 A |
| 2,976,242 | 6/1957 | Sarto | 261/34 A |
| 3,013,779 | 12/1961 | Kalert, Jr. et al. | 261/34 A |
| 3,045,505 | 7/1962 | Boehlow | 261/34 A |
| 3,208,738 | 9/1965 | Johnson | 261/34 A |
| 3,764,119 | 10/1973 | Niebrzydoski | 261/34 A |
| 3,957,929 | 5/1976 | Gural et al. | 261/34 A |

*Primary Examiner*—Tim R. Miles

[57] ABSTRACT

An accelerator pump for providing additional fuel to the carburetor of an internal combustion engine during acceleration permits staged or sequential operation of the pump while employing simplified construction. The structure is arranged so that the accelerating pump is caused to travel during an initial opening of a primary throttle of the carburetor, after which the pump ceases to move until a secondary throttle begins to open, at which time additional pumping action is accomplished.

14 Claims, 4 Drawing Figures

STAGED ACCELERATOR PUMP

BACKGROUND OF THE INVENTION

This invention relates to pump structures and in particular to an accelerator pump for staged carburetors. While the invention is described with respect to its use with staged carburetors, those skilled in the art will recognize the wider applicability of the inventive principles disclosed hereinafter.

Two stage carburetors are well known in the art, and typically are exemplified by the well known four barrel carburetor finding application on a number of internal combustion engines in the United States. Four barrel carburetors have a pair of primary throttles and a pair of secondary throttles, which, by way of suitable linkages, are caused to open in a sequential manner. When both throttles are fully open, the engine is able to deliver maximum performance. In a typical carburetor of the four barrel variety, an accelerator pump is provided which delivers a small quantity of additional fuel during opening movement of the primary throttle. This additional fuel is usually necessary if the rapid and immediate response which the public is accustom is to be realized. In most four barrel carburetor arrangements, after a predetermined amount of opening of the primary throttle, the accelerator pump no longer delivers additional fuel either because it has reached the end of its travel or because a stop mechanism has been brought into action to prevent any such additional travel. The result of this situation is that the accelerator pump is not available to make an additional discharge of fuel upon opening of the secondary throttle. To overcome this deficiency, various structures have been employed to initiate additional fuel flow immediately before, at or during opening of the secondary throttle. One particularly advantageous method of accomplishing the additional fuel flow is described in the U.S. Pat. No. to Niebrzydoski, 3,764,119, issued Oct. 9, 1973, and assigned to the assignee of the present invention. Conventional carburetor structure not described hereinafter is intended to be incorporated by reference to the Niebrzydoski patent.

Although the Niebrzydoski patent works well for its intended purpose, it generally requires relatively complicated, and consequently expensive linkages to accomplish its result. The invention disclosed hereinafter overcomes this deficiency by providing a simply constructed accelerator pump which provides additional fuel as the primary throttle begins an opening movement after which the accelerator pump does not discharge additional fuel until the secondary throttle begins to open, at which time the accelerator pump will resume its movement to discharge additional fuel.

One of the objects of this invention is to provide a two position accelerating pump for a carburetor of an internal combustion engine.

Another object of this invention is to provide a low cost accelerating pump useful with two stage carburetors.

Another object of this invention is to provide an accelerating pump which provides a first discharge upon the opening of the primary throttle, after which the pump does not discharge until the secondary throttle begins to open.

Other objects of this invention will be apparent to those skilled in the art in light of the following description and accompanying drawings.

SUMMARY OF THE INVENTION

In accordance with this invention, generally stated, an accelerator pump having simplified structure is provided which discharges upon the opening movement of the primary throttle of a two stage carburetor. During normal run conditions, the accelerator pump remains stationary. When the secondary throttle begins to open, the accelerator pump again discharges additional fuel, the additional discharge being accomplished under direct, positive control.

DESCRIPTION OF THE PREFERRED EMBODIMENT

Figure 1:
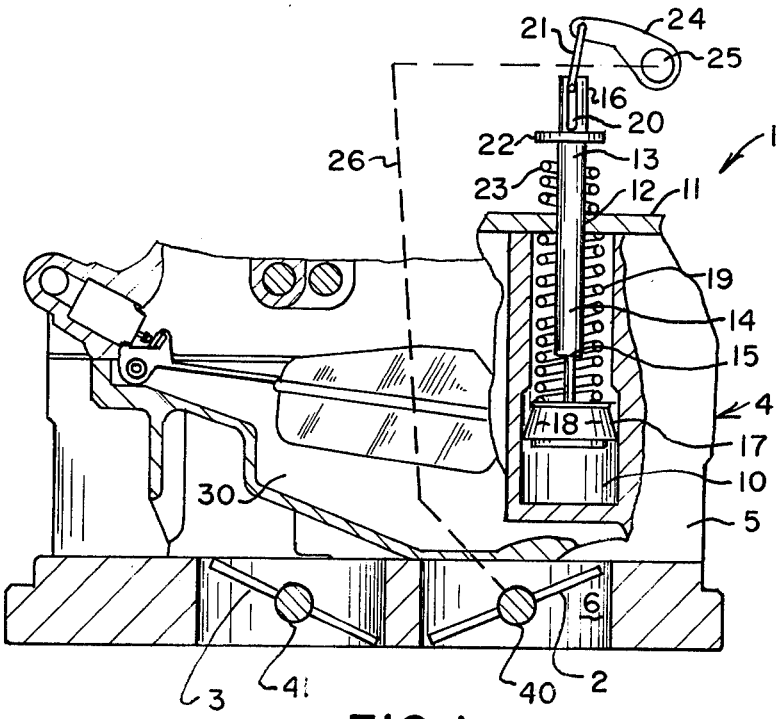
FIG. 1 is a partial sectional view of a staged carburetor showing and employing one illustrative embodiment of accelerator pump of this invention.
Figure 2:
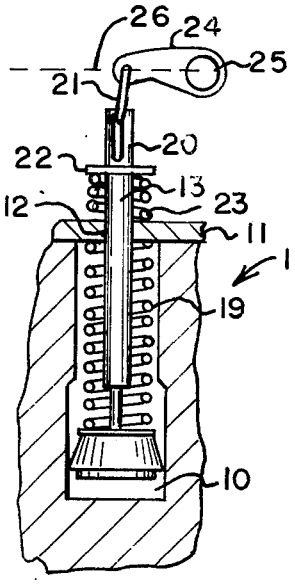
FIG. 2 is a sectional view, partly broken away, of the accelerator pump shown in FIG. 1, illustrating the operation of the pump upon movement of the primary throttle.

Referring now to FIG. 1, reference numeral 1 indicates one illustrative embodiment of accelerator pump of this invention. The pump 1 finds application with the stage variety of carburetor 4 in which there is one or a plurality of primary throttles, diagrammatically illustrated in FIG. 1 and denominated by the reference 2, and one or a plurality of secondary throttles, diagrammatically illustrated in FIG. 1 and denominated by the reference 3.

Although not shown and described, it will be appreciated by those familiar with the field, that the carburetor 4 is provided with a fuel supply, the usual fuel circuits and an air/fuel mixing chamber. The carburetor 4 also includes a body 5 having a main air passageway 6 through it. The air passageway 6 is operatively connected between an air horn, not shown, and the intake manifold of an internal combustion engine, likewise not shown. Fuel is supplied to a fuel fitting of the carburetor from a carburetor fuel bowl 30. Output from the fuel bowl 30 is regulated by a fuel control valve of a conventional design. The throttles 2 and 3 are operatively connected by suitable linkages to permit an operator of an internal combustion engine with which the carburetor 4 finds application to control operating speed of the engine by regulating the air/fuel input thereto, that input being dependent on throttle position. For purposes of description, the accelerator pump 1 is shown as located within the fuel bowl 30 and as being coupled to at least one of a pair of shafts 40 and 41. The shafts 40 and 41 are rotatably mounted with respect to the carburetor 4. The throttles 2 and 3 are attached to and rotate with their respective shafts. Those skilled in the art will recognize that the arrangement shown merely facilitates description of the structure and operation of the pump 1. A number of other structural arrangements are compatible with that operation.

The accelerating pump 1 includes a pumping chamber 10. Pumping chamber 10 is connected to the main air passage 6 of the carburetor 4 by a suitable conduit, not shown. The pumping chamber 10 is closed at a first end by a stop means 11 which may form a part of the carburetor 4 structure or the stop means 11 may be a separately manufactured component, if desired. Stop means 11 has an opening 12 in it, which permits passage of a valve stem 13. Valve stem 13 includes a body 14 having a first end 15 and a second end 16.

The end 15 of the valve stem 13 has a pump means 17 attached to it. The pump means 17 includes a piston 18 which varies the volume of the pump chamber 10 to drain or emit fuel in a conventional pumping action. Piston 18 may be constructed from any suitable material that exhibits long life properties in the fuel mixture environment of the pump 1. A spring 19 is biased between the stop means 11 and the pump piston 18. The spring 19 is biased to force the piston 18 in a discharge direction, that direction being downwardly as referenced to the drawings. Spring 19 may be and preferably is a conventional coil compression spring.

The end 16 of the valve stem 13 has a slot 20 formed in it. The slot 20 receives a link 21, later described in detail.

A boss 22 is attached to the stem 13, near the lower end of the slot 20 on the end 16 side of the stem, as referenced to FIG. 1. The boss 22 may be integrally formed with the stem 13, or it may be manufactured separately and later attached by any convenient method. A conventional metal washer of suitable thickness works well for the boss 22, for example. A second spring 23 is mounted over the valve stem 13. The spring 23 abuts the stop means 11 on one end of the spring. The spring 23 is unbiased in at least one position of the primary throttle 2. However, spring 23 engages the boss 22 during pump 1 operation as later described. The spring 23 also preferably is of the coil compression type. As shown in FIG. 1, the spring 19 and 23 are axially aligned with one another, but are positioned so that they exert diametrically opposite forces of the stem 13, in those position of the pump 1 where the spring 23 engages the boss 22.

A lever 24 is pivotally mounted along a first end of the lever at a suitable location on the carburetor 4 structure, the mounting generally being indicated by the reference numeral 25. A second end of the lever 24 has the link 21 attached to it. The lever 24 and link 21 constitute a drive means for the accelerator pump 1. Attachment of the link 21 and lever 24 preferably is accomplished so that the two parts rotate with respect to one another for a first degree of angular motion by the lever 24. However, the parts interlock to form a single lever arm if angular motion continues in the same direction about the mounting 25. That is to say, the lever 24 and link 21 interlock to form a single lever arm if angular motion in a counterclockwise direction, referenced to FIG. 1, is continued past some predetermined point. The lever 24 is operatively connected to at least one of the first and secondary throttles 2 and 3, as diagrammatically illustrated at 26. Although the link 21 and lever 24 are illustratively shown as having a preferred shape, that shape may vary in other embodiments of the invention, depending in large measure on the location of the mounting 25 with respect to the pump 1.

Figure 3:
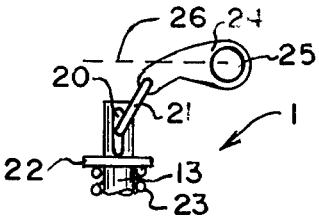
FIG. 3 is a sectional view, partly broken away, of the accelerator pump shown in FIG. 1, illustrating operation of the pump during normal operating positions of the primary throttle.
Figure 4:
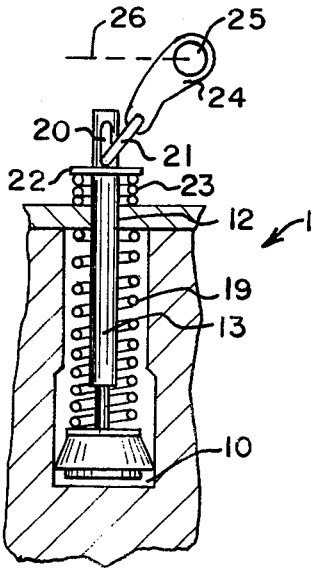
FIG. 4 is a sectional view, partly broken away, illustrating the operation of the pump upon movement of the secondary throttle.

Operation of the accelerator pump of this invention is relatively easy to understand. FIG. 1 illustrates the position where both the primary and secondary throttles are closed. As the primary throttle 2 opens, the lever 24 rotates in a counterclockwise direction, referenced to the drawings. Rotation of the lever 24 about the mounting 25 releases the stem 13 because of the relative rotation between the link 21 and lever 24. Consequently, the spring 19 forces the stem 13 downwardly permitting the pump means 17 to discharge fuel from the pumping chamber 10. The link 21 remains positioned along the top of the slot 20 because of the spring 19 induced movement to the stem 13. Movement of the stem 13 continues until the boss 22 meets the spring 23. At that time, the spring 23 begins to exert a spring force opposing the force of the spring 19, until an equilibrium position for the stem 13 is reached. Closure of the primary throttle 2 at this point, of course, would draw the stem 13 upwardly, repositioning the pump means 17 for the next primary throttle opening. However, continued opening of the primary throttle 2 position causes continued counterclockwise rotation of the lever 24. Because the stem 13 is in equilibrium between the force provided by the springs 19 and 23, the link 21 moves downwardly in the slot 20, as illustratively shown in FIG. 3. Consequently, a lost motion movement occurs between the valve stem and the drive means of the pump.

As the primary throttle continues to open, the link 21 reaches the bottom of the slot 20 and interlocks with the lever 24. The distance of travel of the link 21 in the slot 20 is chosen so that it corresponds to some desired operating point of the secondary throttle 3. The operating point may be the initial opening of the throttle 3, for example. At that point, the lever 24 and link 21 begin to exert a positive force on the stem 13. That is, the link 21 and lever 24 become a single lever arm which begins to exert a downward force on the stem 13. The positive force of the link 21-lever 24 combination overcomes the force of the spring 23 and forces the stem 13 downwardly, thereby discharging an additional amount of fuel, that discharge corresponding to the chosen operating point of the secondary throttle 3.

It thus may be observed that an accelerator pump structure is provided which meets all the ends and objects herein set forth above.

Numerous variations, within the scope of the appended claims, will be apparent to those skilled in the art in light of the foregoing description and accompanying drawings. Thus, the design silhouette and location of various components may vary in other embodiment of this invention. As indicated, the interconnections between the accelerator pump 1 and the primary and secondary throttles 2 and 3 were illustrated diagrammatically. Those connections may take a variety of forms in actual embodiments of the invention. While the spring 19 and 23 were shown as conventional coil compression springs, other spring forms are compatible with the broader aspects of this invention. Likewise, the capacity and operating points of the pump 1 may be changed. Various materials and components described as preferred may be altered. These variations are merely illustrative.

I claim:

1. In a multi stage carburetor having a first throttle and a second throttle, the improvement comprising means for providing an additional fuel charge upon activation of each of said throttles, said additional fuel charge means comprising an accelerator pump including a pump chamber, said pump chamber having stop means on one end thereof, a valve stem passing through said stop means, a first spring on one side of said stop means for urging said pump in a first, pumping direction, said stem having a slotted second end, a boss mounted to said stem along said second end, a second spring mounted along the second end of said stem, said second spring being spaced from said boss in at least one position of said first and said second throttles, and positioned to engage said boss in one direction of stem movement, a pump operating lever pivotally mounted to said carburetor and operatively connected to at least one of said first and said second throttles, said lever including a link mounted in the slot of said stem, said link and said lever arranged so that initial movement of said lever allows said first spring to actuate said pump until said boss engages said second spring, continued rotation of said lever causing said link to move to the bottom of said slot and interlocking with said lever so that additional lever movement overcomes said second spring and positively drives said stem in a pumping direction.

2. The improvement of claim 1 wherein said first and second springs are coil compression springs axially aligned with one another.

3. The improvement of claim 2 wherein said boss comprises a washer mounted to said stem.

4. The improvement of claim 3 wherein said pump includes a piston attached to said stem, said first spring being biased between said piston and said stop means.

5. An accelerating pump for a carburetor, comprising:

a valve stem having pump means mounted to a first end and a slotted second end;

a first spring means mounted to urge said pump means in a pumping direction;

a boss attached to said shaft near said slotted end;

second spring means unbiased in a first position of said stem and positioned to engage said boss in a second position of said stem; and a pump operating lever movably mounted to said carburetor, said lever including a link means connected between said lever and the slot in said shaft, movement of said lever permitting said first spring means to move said pump means in a pumping direction until said second spring engages said boss, said link moving in said slot upon further movement of said lever until said lever and link interlock and positively drive said stem to overcome the force of said second spring, thereby further urging said pump means in a pumping direction.

6. The accelerator pump of claim 5 wherein said first and said second spring means are coil compression springs.

7. The accelerator pump of claim 6 wherein said boss comprises a washer mounted to said stem.

8. An accelerating pump for a carburetor, comprising: a valve stem having pump means mounted to a first end thereof and a slotted second end;

first spring means biased to urge said stem in a pumping direction;

second spring means unbiased in a first position of said stem;

boss means mounted to said stem along said slotted end thereof; and a lever pivotally mounted to said carburetor including a link engageable with a first end of said slot to control movement of said stem, movement of said lever permitting said first spring to urge said stem in a pumping direction until said boss engages said second spring, further movement of said lever causing said link to move along said slot to engage said stem and directly drive said stem in a pumping direction, thereby overcoming the force of said second spring.

9. An accelerating pump, comprising:

a valve stem having a first end and a second end, said valve stem having a pump means mounted to said first end;

first spring means biased to urge said stem in a pumping direction;

second spring means unbiased in a first position of said stem;

boss means mounted to said stem along the second end thereof; and drive means including a movable part for urging said valve stem in a pumping direction, said drive means being operatively connected to the second end of said valve stem, movement of said drive means permitting said first spring to urge said stem in a pumping direction until said boss engages said second spring, further movement of said drive means including a first lost motion movement portion and a second direct drive portion whereby said drive means overcomes the force of said second spring and directly drives said stem in a pumping direction.

10. The pump of claim 9 wherein the movable part of said drive means includes a lever pivotally mounted with respect to said valve stem, and a link operatively connected between said lever and said valve stem.

11. The pump of claim 10 wherein said boss means comprises an annulus mounted to said valve stem.

12. The pump of claim 11 wherein said first and second springs are axially aligned with one another.

13. The pump of claim 12 wherein said valve stem has a slot formed in it along the second end of said valve stem, said link being movable in said slot in at least one position of said pump to provide said lost motion movement of said drive means.

14. The pump of claim 13 wherein said pump means includes a piston attached to the first end of said valve stem, said first spring engaging said piston to urge said piston in a pumping direction.

* * * * *